US005425258A

United States Patent [19]

Bogart

[11] Patent Number: 5,425,258

[45] Date of Patent: Jun. 20, 1995

[54] NEEDLE CURVING APPARATUS

[75] Inventor: Michael W. Bogart, Bridgeport, Conn.

[73] Assignee: United States Surgical Corporation, Norwalk, Conn.

[21] Appl. No.: 175,496

[22] Filed: Dec. 30, 1993

Related U.S. Application Data

[63] Continuation of Ser. No. 958,926, Oct. 9, 1992, abandoned.

[51] Int. Cl.[6] ..... B21G 1/00

[52] U.S. Cl. ..... 72/169; 72/173; 163/1

[58] Field of Search ..... 72/133, 170, 171, 172, 72/173, 174, 146, 166, 368, 379.2, 379.4, 369, 169; 163/1, 5

[56] References Cited

U.S. PATENT DOCUMENTS

| | | | |
|---|---|---|---|
| 1,427,101 | 8/1992 | Gilbert . | |
| 1,590,491 | 6/1926 | Beall . | |
| 1,666,909 | 4/1928 | Philippi . | |
| 1,676,173 | 7/1928 | Wermes . | |
| 1,688,099 | 10/1928 | Wagenbach . | |
| 1,697,896 | 1/1929 | Yates . | |
| 1,702,856 | 2/1929 | Trosch . | |
| 2,093,933 | 9/1937 | Sinclair . | |
| 2,215,111 | 9/1940 | Tucker | 72/169 |
| 2,309,963 | 2/1943 | Krueger . | |
| 2,353,925 | 7/1944 | Pattison . | |
| 2,457,705 | 12/1948 | Moran . | |
| 2,579,858 | 12/1951 | Price . | |
| 2,647,743 | 8/1953 | Cook . | |
| 2,722,261 | 11/1955 | Bishop . | |
| 2,739,763 | 3/1956 | Silfverlin et al. . | |
| 2,756,803 | 7/1956 | Faeber | 72/166 |
| 2,937,821 | 5/1960 | O'Brien . | |
| 2,990,001 | 6/1961 | Hansen | 72/166 |
| 3,038,475 | 6/1962 | Orcutt . | |
| 3,040,798 | 6/1962 | Johnson | 72/172 |
| 3,064,711 | 11/1962 | Fuchs, Jr. . | |
| 3,112,087 | 11/1963 | Fornataro | 72/166 |
| 3,279,229 | 10/1966 | Lagher . | |
| 3,326,025 | 6/1967 | Nishioka . | |
| 3,357,222 | 12/1967 | Konstandt | 72/146 |
| 3,444,716 | 5/1969 | Martin . | |
| 3,456,321 | 7/1969 | Furt et al. . | |
| 3,608,347 | 9/1971 | Kemminer . | |
| 3,704,616 | 12/1972 | Taira . | |
| 3,808,863 | 5/1974 | Marcovitch . | |
| 3,937,052 | 2/1976 | Hoexter et al. . | |
| 3,994,656 | 11/1976 | Van Ausdall | 72/170 |
| 4,040,283 | 8/1977 | Suriano . | |
| 4,063,442 | 12/1977 | Martin, Sr. | 72/166 |
| 4,145,904 | 3/1979 | Giros et al. | 72/142 |
| 4,312,208 | 1/1982 | Schafer . | |
| 4,346,577 | 8/1982 | Peters et al. . | |
| 4,524,771 | 1/1985 | McGregor et al. . | |
| 4,633,698 | 1/1987 | Oetiker . | |
| 4,702,097 | 10/1987 | Zahlaus . | |
| 4,777,816 | 10/1988 | Inoue . | |
| 5,041,127 | 8/1991 | Troutman . | |

FOREIGN PATENT DOCUMENTS

| | | | |
|---|---|---|---|
| 2385462 | 10/1978 | France . | |
| 61-9927 | 1/1986 | Japan | 72/166 |
| 88-73989 | 4/1988 | Japan . | |
| 63-309338 | 12/1988 | Japan . | |
| 3-118050 | 5/1991 | Japan . | |
| 3230836 | 10/1991 | Japan . | |
| 54818 | 6/1942 | Netherlands . | |

OTHER PUBLICATIONS

Japan Patent Abstract Publication No. JP3281025, publication date Dec. 11, 1991.

Japan Patent Abstract Publication No JP1138030, publication date May 30, 1989.

*Primary Examiner*—Lowell A. Larson

*Assistant Examiner*—Thomas C. Schoeffler

[57] ABSTRACT

The present invention relates to a needle curving apparatus for curving one needle or a multiplicity of needles simultaneously. The apparatus includes a curving system for bending the needle and a reciprocating drive system for biasing the needle blanks against the curving system and reciprocally moving the needle blanks to form the curved needle.

10 Claims, 9 Drawing Sheets

NEEDLE CURVING APPARATUS

This is a continuation, of application Ser. No. 07/958,926, filed on Oct. 9, 1992, now abandoned.

BACKGROUND OF THE INVENTION

1. Field of the Invention

The present invention relates to needle curving devices. More particularly, the invention relates to a reciprocating needle curving device for curving one needle or a multiplicity of needles simultaneously.

2. Description of the Related Art

The production of needles involves many processes and different types of machinery in order to prepare quality needles from raw stock. These varying processes and machinery become more critical in the preparation of surgical needles where the environment of intended use is in humans or animals. Some of the processes involved in the production of surgical grade needles include, inter alia: straightening spooled wire stock, cutting needle blanks from raw stock, tapering or grinding points on one end of the blank, providing a bore for receiving suture thread at the other end of the blank, flat pressing a portion of the needle barrel to facilitate easier grasping by surgical instrumentation, and curving the needle where curved needles are desired. Conventional needle processing is, in large part, a labor intensive operation requiring highly skilled workmen. Generally, extreme care must be taken to ensure that only the intended working of the needle is performed and the other parts of the needle remain undisturbed.

Curved needles have advantages over other needle configurations in many surgical procedures for a variety of reasons including, uniformity of entry depth for multiple sutures and proper "bite" of tissue surrounding the incision or wound. When providing curved needles for surgical procedures it is desirable for the needles to have a specified curvature, i.e., a predetermined radius of curvature. The predetermined radius of curvature for the needle varies with specific applications.

Conventional needle curving techniques create the curve by manually bending the machined needle around an anvil structure having a desired curvature. To attain the desired needle configuration, the anvil structure provides a shaping surface for deforming the needle. Typically, the needle is positioned for curving by manually placing the needle for engagement with the anvil structure and holding it in place by a holding device. The needle is subsequently bent by manually manipulating the holding device so the needle curvature is formed about the shaping surface of the anvil structure.

When needles are made of steel or similar resilient materials, the anvil or mandrel used should have a smaller radius than the radius desired in the final needle. This configuration allows for some springback after the bending operation and ensures that the desired radius of curvature is attained. A disclosure of such features may be found in, for example, U.S. Pat. No. 4,534,771 to McGregor et al.

One disadvantage to conventional needle curving techniques is that only one needle can be curved around an anvil structure at a time. Another disadvantage is that the needle is manually positioned for engagement about the anvil surface. Lastly, the incidence of needle damage during the curving process is relatively high due to the manual placement and bending of the needle.

Therefore a need exists for a needle curving device that is capable of simultaneously curving a multiplicity of needles or curving a single needle without the high incidence of needle damage. It is also desirable to provide a needle curving device which cooperates with a needle holding fixture for positioning one or more needles for curving so as to increase the production rate of the suture manufacturing process.

SUMMARY OF THE INVENTION

The present invention provides an apparatus for forming curved surgical needles which includes curving means for imparting an arcuate profile to a needle blank and reciprocating means for biasing and reciprocally moving the needle blank against the curving means. The needles are fashioned to form a curvature having a predetermined radius. The curving means includes mandrel means adapted to selectively engage the reciprocating means. The reciprocating means includes a pair of rotatable members positioned in adjacency and drive belt means positioned about the pair of rotatable members for biasing and reciprocally moving the needle blank against the curving means. The apparatus also includes biasing means for applying a continuous force to at least one of the pair of rotatable members such that a friction fit is maintained between the curving means, the pair of rotatable members and the needles blanks when the curving means is engaged with the reciprocating means.

The invention also relates to a method for forming curved surgical needles which includes providing means for forming curved needles, the forming means having curving means for imparting an arcuate profile to a needle blank and reciprocating means for biasing and reciprocally moving the needle blank against the curving means, positioning a surgical needle into a needle shaping zone, activating the reciprocating means to bias the needle blank against the curving means and to reciprocally move at least a portion of the reciprocating means such that the needle blank is traversed within the needle curving zone to form a curvature in the needle blank having a predetermined radius.

BRIEF DESCRIPTION OF THE DRAWINGS

Preferred embodiments of the invention are described hereinbelow with reference to the drawings wherein.

DETAILED DESCRIPTION OF PREFERRED EMBODIMENTS

Figure 1:
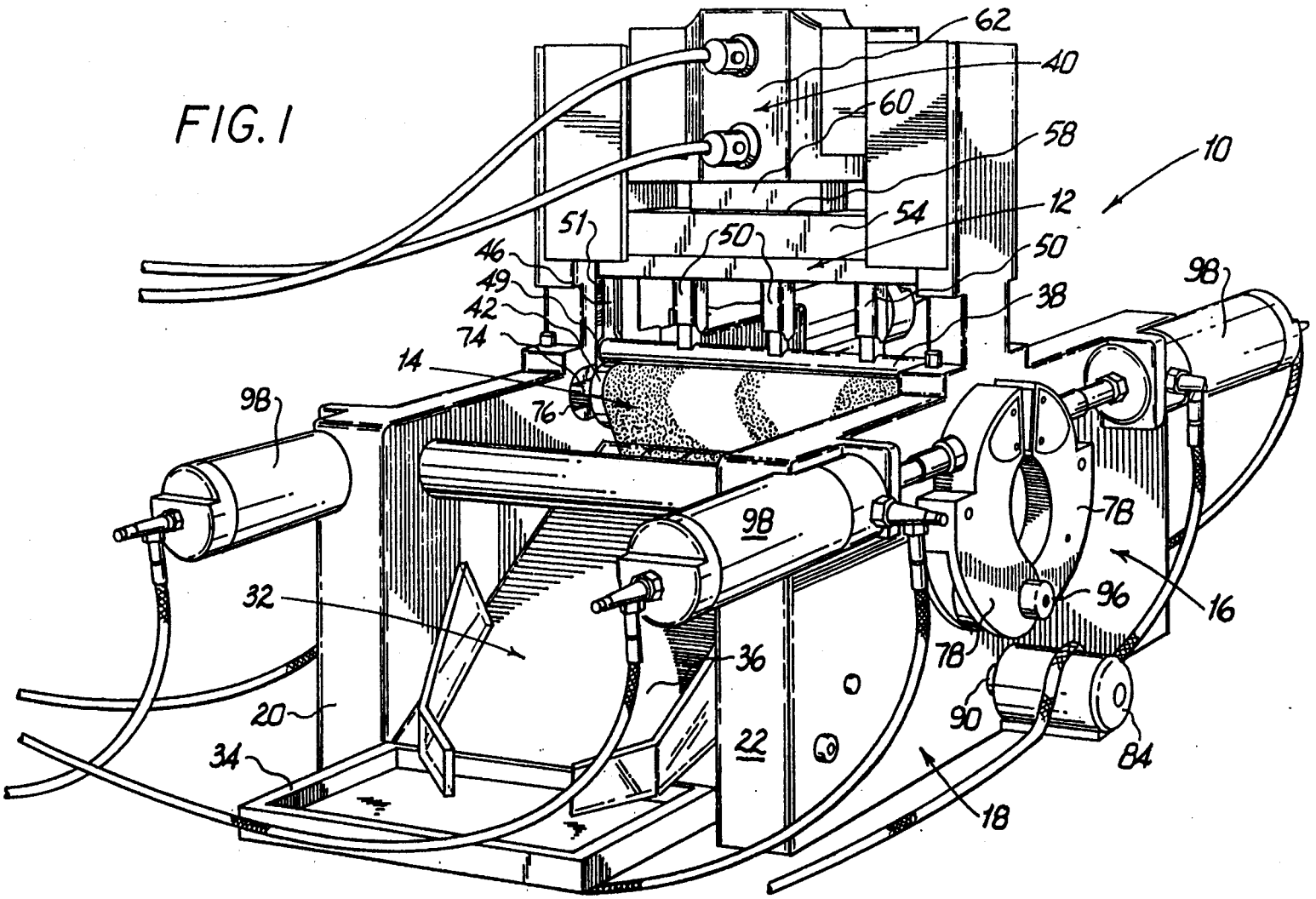
FIG. 1 is a perspective view of the needle curving apparatus of the present invention.

Generally, the needle curving apparatus of the present invention is utilized to curve or bend a multiplicity of needle blanks simultaneously. However curving or bending of a single needle blank is also contemplated. As used herein the term needle blank refers to a surgical needle in various stages of fabrication. The needle curving apparatus 10 generally includes curving system 12, reciprocating system 14 and roller biasing system 16, all of which are, preferably, connected to frame 18.

Figure 2:
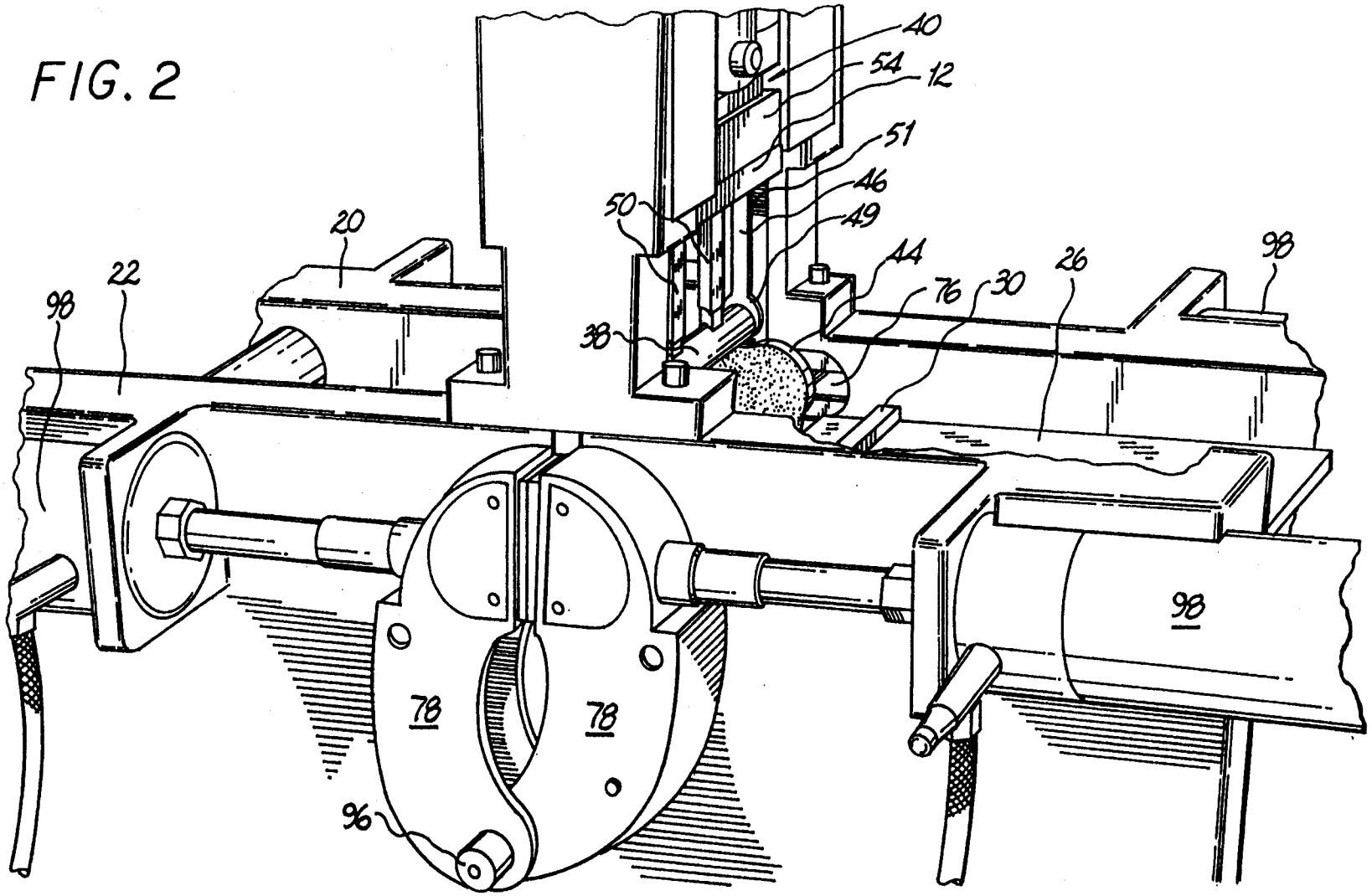
FIG. 2 is an enlarged perspective view of a portion of the needle curving apparatus of FIG. 1, illustrating the needle supply table and a portion of the compression system.

Referring to FIGS. 1 and 2, frame 18 has two side walls 20 and 22 which are spatially positioned apart in a parallel orientation. Mandrel housing 24 is positioned above and between side walls 20 and 22 and houses the mandrel drive system. Needle supply table 26, shown in FIG. 2, is provided to support side walls 20 and 22 and to receive needle clamp 28, shown in FIG. 3.

Figure 3:
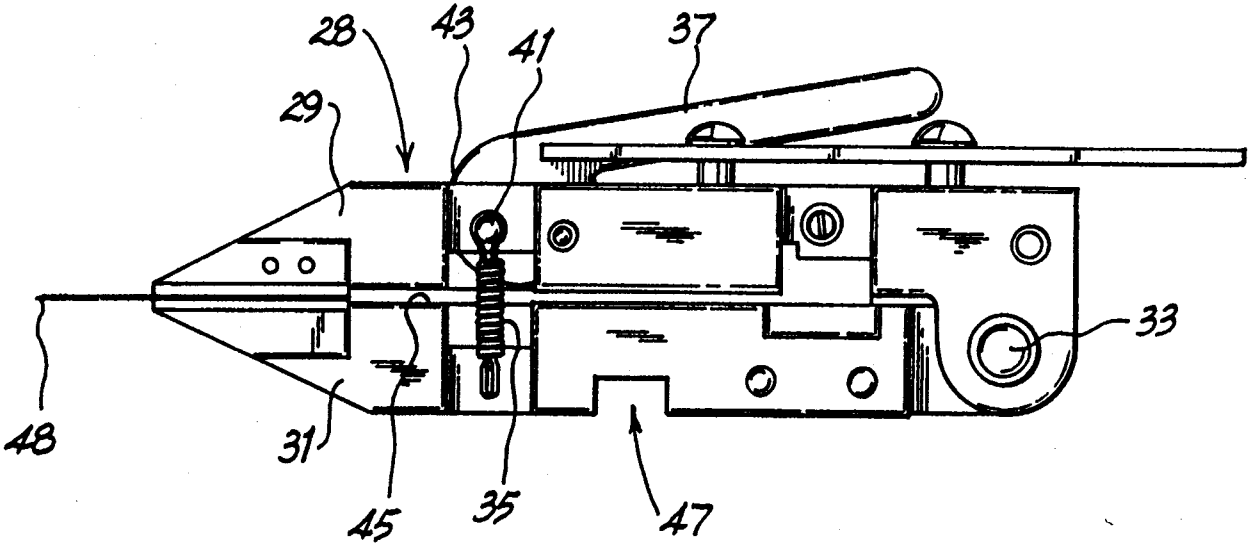
FIG. 3 is a side elevational view of the needle clamp having needle blanks clamped therein, which is utilized with the needle curving apparatus of the present invention.

Referring now to FIG. 3, needle clamp 28 is configured, dimensioned and adapted to retain and position a multiplicity of needle blanks for curving. For example, needle clamp 28 may include a pair of opposing jaw members 29 and 31 pivotally connected by retaining pin 33. Jaw members 29 and 31 are normally biased toward each other under the action of spring 35. Release lever 37 is pivotally secured to jaw 29 by pin 41 and is provided to open the jaws when camming surface 43 of release lever 37 cams against the upper surface 45 of jaw 31 member in response to pivotal movement of release lever 37. Channel 47 in jaw member 31 is provided to align needle clamp 28 on needle supply table 26. Needle clamp stop 30, shown in FIG. 2, is positioned on needle supply table 26 and is provided to engage channel 37 of needle clamp 28 to properly align needle clamp 28 on needle supply table 26. Needle clamp stop 30 ensures that the needle blanks are properly positioned for subsequent bending, as will be described below.

Referring to FIG. 1, needle recovery assembly 32 is positioned between side walls 20 and 22 and is provided to direct the newly curved needles into receiving tray 34. Preferably, needle recovery assembly 32 includes an inclined plexiglass sheet 36 oriented between side walls 20 and 22, with the low end of the incline positioned adjacent receiving tray 34 and the high end positioned adjacent to reciprocating system 14. In this configuration, the newly curved needles simply slide along plexiglass sheet 36 into receiving tray 34. However, needle recovery assembly 32 may be any other known type of system utilized for the recovery and subsequent transfer of various items within a production line, such as a conveyor belt system.

Referring once again to FIGS. 1 and 2, needle shaping or curving system 12 of the present invention preferably includes mandrel 38 and mandrel drive system 40 to impart an arcuate profile to the needle blanks. However, other known types of needle shaping systems may be utilized to impart a predetermined configuration to the needle blanks. Such predetermined configurations include, but are not limited to, angular configurations such as an "L" shaped needle.

Mandrel 38 is an elongated shaft or rod transversely positioned between side walls 20 and 22 of frame 18 and is connected at each end to side drive arms 46. Preferably, mandrel 38 has a solid cross-section and is fabricated from a material having a hardness which is at least substantially equal to the hardness of the needle material. Typically, mandrel 38 has a Rockwell hardness value between about 55C and about 57C which discourages unwanted shaping or marring of the needle blank and/or the mandrel. In addition, mandrel 38 may be coated with an elastomer material to help prevent unwanted marring of needle blank 48 and/or mandrel 38 during the curving process.

Preferably, the mandrel has a circular cross-section to impart an arcuate profile to the needle blank resulting in a curved surgical needle having a predetermined radius of curvature of between about 0.05 inches and about 3.00 inches. However, surgical needles requiring different arcuate profiles require various shaped mandrels, such as elliptical, triangular, rectangular or pear-shaped mandrels which impart a predetermined curvature to the needle blanks.

The diameter of the preferred circular mandrel is dependent on numerous factors including the length of the needle blank, the desired radius of curvature and the spring back characteristics of the needle material, i.e., the tendency of the needle material to return to its original shape after being deformed. To illustrate, larger diameter mandrels produce a large radius of curvature and smaller diameter mandrels produce a smaller radius of curvature. Further, in instances where the needle blank is fabricated from a material having spring back tendencies, the mandrel diameter should be smaller than the desired radius of curvature so that the needle will spring back to the desired radius of curvature after bending. The apparatus of the present invention is configured to accommodate mandrels with various diameters necessary for curving surgical needles of various sizes.

Referring to FIGS. 1 and 2, side drive arms 46 are utilized to support mandrel 38, as noted above. Preferably, side drive arms 46 are rigid members having a lower portion 49 configured and dimensioned to secure each end portion of mandrel 38 as shown. Preferably, mandrel 38 is rotatably mounted between arms 46. The upper portion of side drive arms 46 are secured to drive bracket 54. Side drive arms 46 are positioned within channel 51 of mandrel housing 24, thus preventing the side drive arms from interfering with the movement of rollers 42 and 44.

Figure 5:
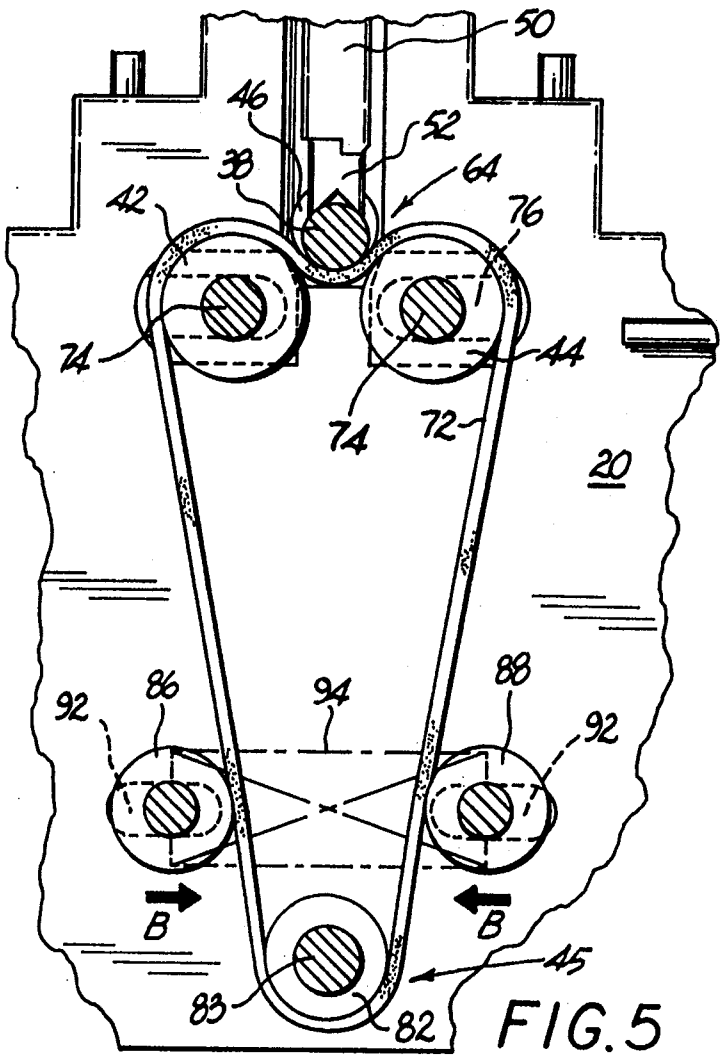
FIG. 5 is a view of the drive system similar to FIG. 4, illustrating the rollers in a separated position and the tensioning system applying tension to the drive belt.
Figure 4:
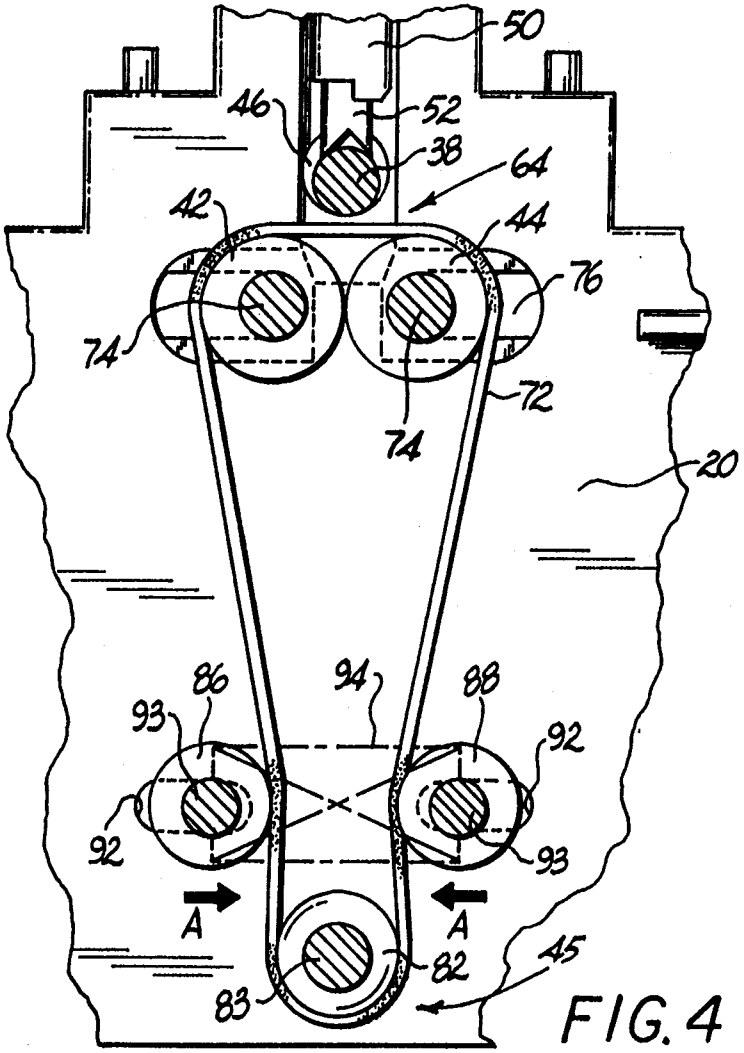
FIG. 4 is a side elevational view of a portion of the drive system of the present invention, illustrating the rollers in their normal position and the tensioning system increasing the tension on the drive belt.

Referring now to FIGS. 1, 4 and 5, a number of center drive arms 50 are positioned in evenly spaced relation along the length of mandrel 38 and are provided to increase the stability of the mandrel, i.e., to prevent mandrel 38 from flexing or bowing, and to provide even distribution of the force exerted by mandrel drive system 40 on mandrel 38 and hence on each needle blank being curved. As shown in FIG. 1, three center drive arms 50 are equally spaced along mandrel 38 to ensure the stability of the mandrel. Preferably, base 52 of each center drive arm 50 has a "V" shape groove configured to communicate with mandrel 38 on two tangential points, as shown in FIG. 4. This configuration enables the apparatus to accommodate any size mandrel without modification. In addition, the "V" shape configuration reduces the friction forces applied to mandrel 38 as it rotates when curving the needle blanks. Center drive arms 50 and side drive arms 46 are fixedly secured to drive bracket 54 of mandrel drive system 40 so that vertical motion of drive bracket 54 causes uniform vertical motion of each drive arm and mandrel 38.

As shown in FIG. 1, drive bracket 54 is slidably secured to mandrel housing 24 and includes upper surface 58 connected to drive piston 60 of cylinder 62. When cylinder 62 is activated, vertical movement of drive piston 60 is transferred to the drive bracket, the drive arms and the mandrel in a uniform manner, as noted above. Preferably, cylinder 62 is a hydraulic cylinder, however, the cylinder may be any other known drive system, such as an electric motor or a pneumatic cylinder.

Figure 6:
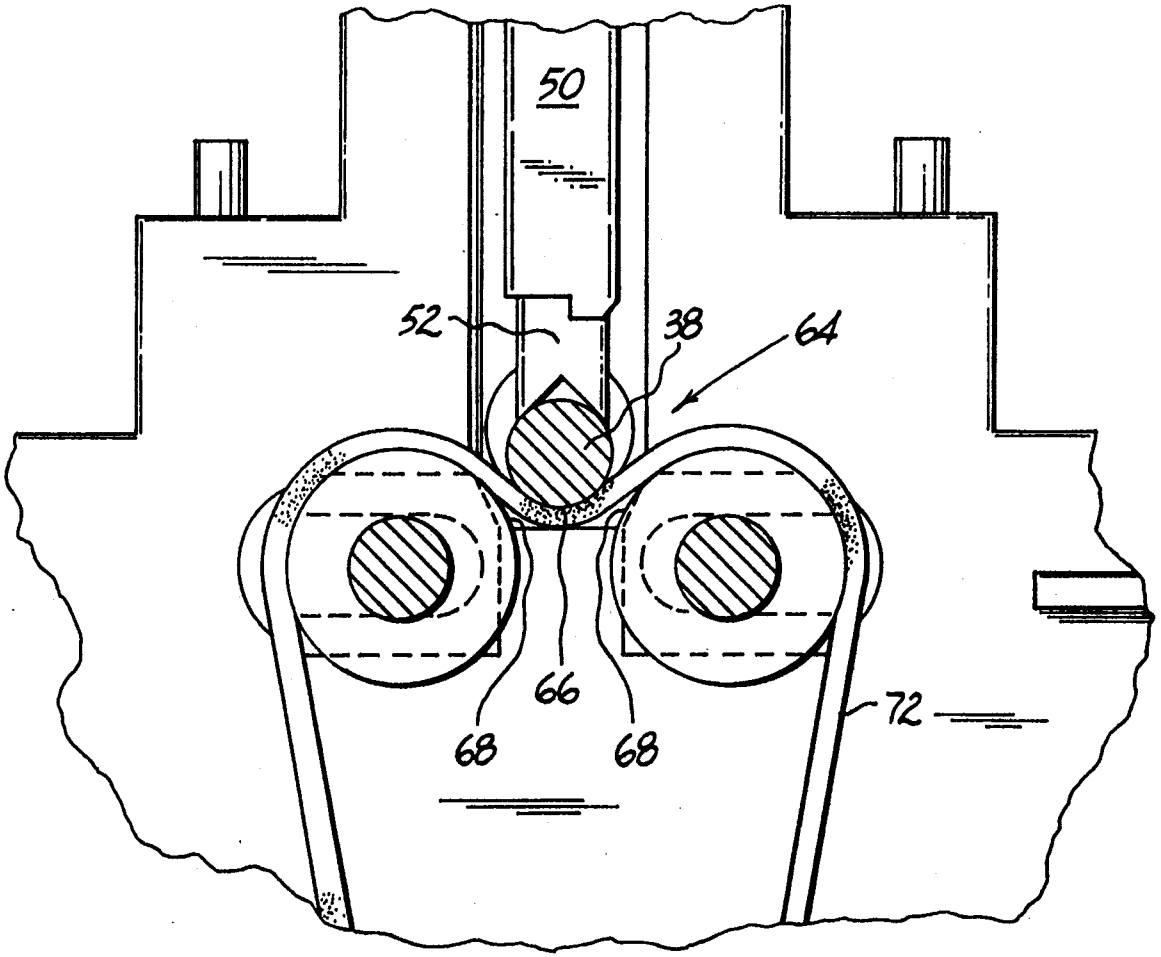
FIG. 6 is an enlarged view of the rollers of FIG. 5, illustrating the needle shaping zone for the present invention.

Referring now to FIGS. 1, 2, 4 and 5, the reciprocating system of the present invention will now be described. Generally, reciprocating system 14 includes rollers 42 and 44, drive system 45 and drive belt 72. Rollers 42 and 44 are slidably secured between and substantially perpendicular to side walls 20 and 22 in close proximity to mandrel 38 to form a portion of the needle curving zone 64, shown in FIGS. 4–6. The needle curving zone includes surface 66 of mandrel 38, the surface 68 of each roller which assists in the deformation of the needle and the portion of drive belt 72 which is located substantially between the rollers and the mandrel.

Referring again to FIGS. 1, 2, 4 and 5, center rod 74 of rollers 42 and 44 extends beyond each end of each roller through slots 76 in each respective side wall 20 or 22 and into engagement with corresponding openings within each compression arm 78. As a result, rollers 42 and 44 are rotatably mounted between frame 18, slidably aligned with each respective side wall and operatively connected to the compression arms. In this configuration, rollers 42 and 44 are slidable within slots 76 between a closed position and a separated position. The closed position is the position where rollers 42 and 44 are biased together without interference from mandrel 38, as shown in FIG. 4. The separated position is the position of rollers 42 and 44 after mandrel 38 is lowered between the rollers, as shown in FIG. 5. The compression arms continuously bias the rollers towards each other and against mandrel 38 when rollers 42 and 44 are in the separated position so as to maintain a continuous friction fit therebetween, as will be discussed in more detail below. Conventional bearings (not shown) may be used to ensure smooth continuous rotation of rollers 42 and 44 with respect to center rod 74.

Preferably, rollers 42 and 44 are molded and ground into a cylindrical shape from a material having a hardness value substantially equivalent to the hardness value of the needle material. Rollers 42 and 44 are then coated with an elastomeric material such as a polyurethane to form a protective layer having sufficient thickness to ensure good frictional contact with drive belt 72 and to help prevent marring of the needle blank. The thickness of the coating on rollers 42 and 44 may be in the range of between about one sixty-fourth of an inch and about one eighth of an inch.

Referring once again to FIGS. 1, 4 and 5, the drive system of the present invention will now be described. Drive system 45 includes drive shaft 82, drive motor 84, drive belt 72 and idler shafts 86 and 88. Drive shaft 82 is positioned between and substantially perpendicular to side walls 20 and 22 of frame 18 so that one end portion is rotatably secured to side wall 20 and the other end portion 83 passes through aperture 90 of side wall 22 and is operatively secured to drive motor 84, shown in FIG. 1. Typically, drive shaft 82 is secured between the side walls so that a substantially triangular shape is formed between rollers 42 and 44 and drive shaft 82, as best shown in FIG. 5.

Preferably, drive belt 72 is a closed loop belt which is routed to enclosed rollers 42 and 44 and drive shaft 82 in a tight frictional fit, as shown in FIGS. 4 and 5. As a result, rotational motion of drive shaft 82 is transferred to rotational movement of rollers 42 and 44. Preferably, drive belt 72 is fabricated from a material which is sufficiently flexible to wrap about rollers 42 and 44 and drive shaft 82 in a friction fit, and of sufficient strength to assist in bending needle blanks 48 about mandrel 38 without damaging the needle blanks. For example, the drive belt may be fabricated from an elastomeric material having a durometer value between about 80 and about 90, such as Neoprene, Nylon, Polyurethane, Kevlar and the like. However, other systems may be utilized to rotate the rollers and assist in bending the needle blanks. For example, a roller system (not shown) may be provided to transfer rotational movement of the drive shaft to the rollers while simultaneously assisting in the bending of the needle blank about the mandrel.

Referring now to FIGS. 4 and 5, idler shafts 86 and 88 are positioned between side walls 20 and 22 parallel to and in close proximity with drive shaft 82 so that drive belt 72 is between drive shaft 82 and idler shafts 86 and 88. As shown, each end portion 93 of idler arms 86 and 88 is slidably secured to side walls 20 and 22 via idler channels 92. Resilient member 94 is provided to normally bias idler shafts 86 and 88 toward each other and includes various known types of biasing mechanisms. For example, resilient member 94 may be a pair of springs connected between each idler shaft at each end portion thereof. Alternately, resilient member 94 may be individual springs secured to each side wall and to one end portion of each idler shaft.

To illustrate the interrelation between the idler shafts and the resilient member, when rollers 42 and 44 are in the closed position, shown in FIG. 4, idler shafts 86 and 88 slide within channels 92 under the biasing action of resilient member 94 to maintain tension on drive belt 72, as shown by arrows A in FIG. 4. Similarly, when rollers 42 and 44 are in the separated position, shown in FIG. 5, idler shafts 86 and 88 slide within channels 92 away from drive belt 72 under the action of the increased tension on drive belt 72 caused when rollers 42 and 44 separate apart in response to the lowering of mandrel 38. However, resilient member 94 continues to bias idler shafts 86 and 88 toward drive belt 72 to maintain sufficient tension on drive belt 72 to prevent slippage between rollers 42 and 44 or drive shaft 82 and drive belt 72, as shown by arrows B in FIG. 5.

Figure 7:
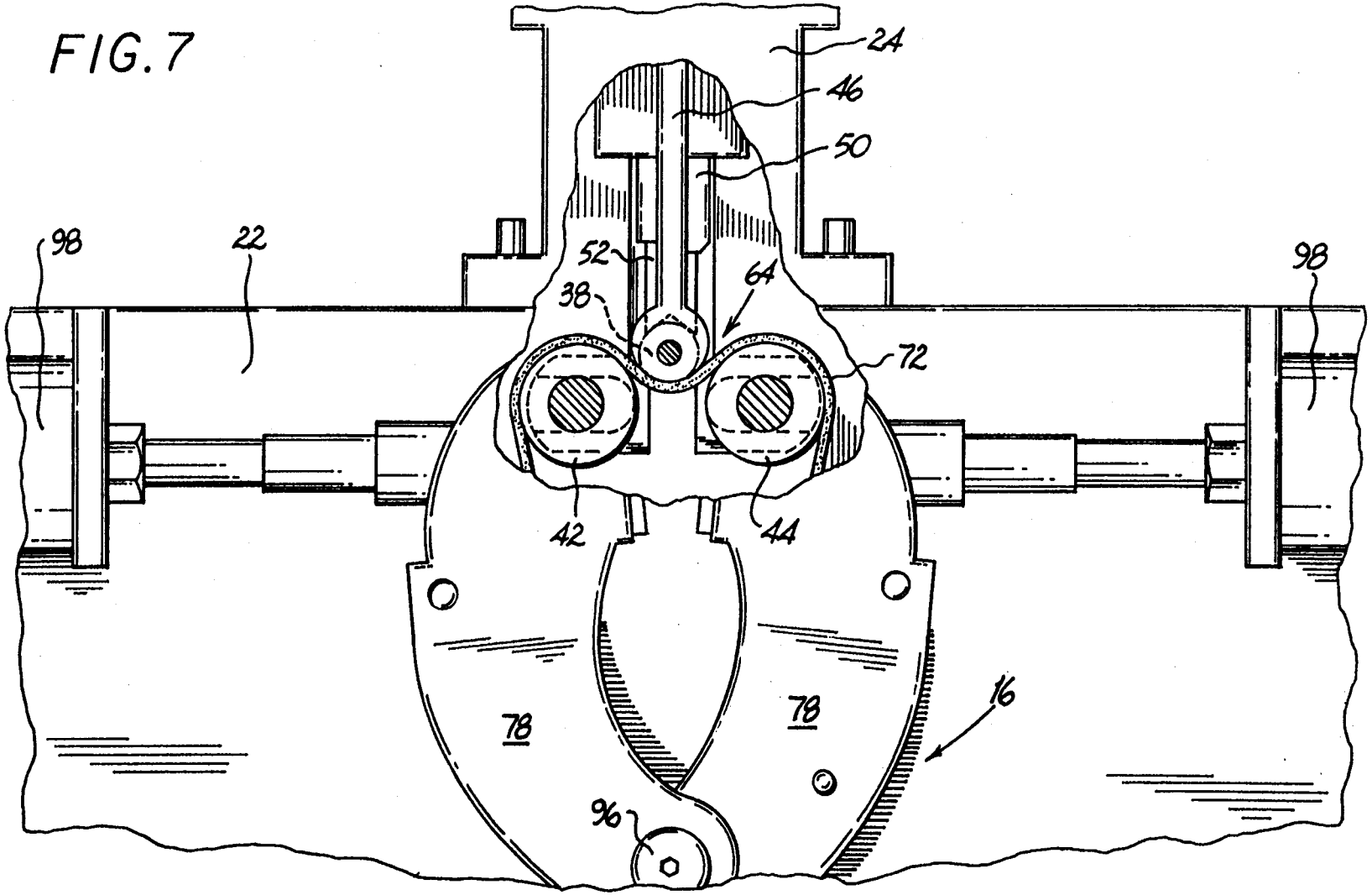
FIG. 7 is an enlarged partial side elevational view in partial cut away of the apparatus of FIG. 1, illustrating the biasing system of the present invention.

Referring now to FIGS. 1 and 7, the roller biasing system of the present invention will now be described. Generally, roller biasing system 16 includes two pairs of compression arms 78, one pair being pivotally secured to each side wall 20, 22 by pivot pins 96 as shown. As mentioned above, compression arms 78 engage the corresponding portion of center rod 74 of each roller so that horizontal movement of rollers 42 and 44, caused when mandrel 38 is lowered between the rollers, opens each pair of compression arms, as shown in FIG. 7. Air springs 98 are secured to frame 18 and to the upper portion of each compression arm 78, as shown in FIG. 1. Air springs 98 are provided to maintain force on compression arms 78 so that when mandrel 38 is pressed between rollers 42 and 44, the forces between the mandrel and the rollers are uniform and sufficient to maintain the needle blank in needle curving zone 64. Preferably, air springs 98 are pneumatic pumps although other means for applying such forces are within the scope of the invention.

Figure 8:
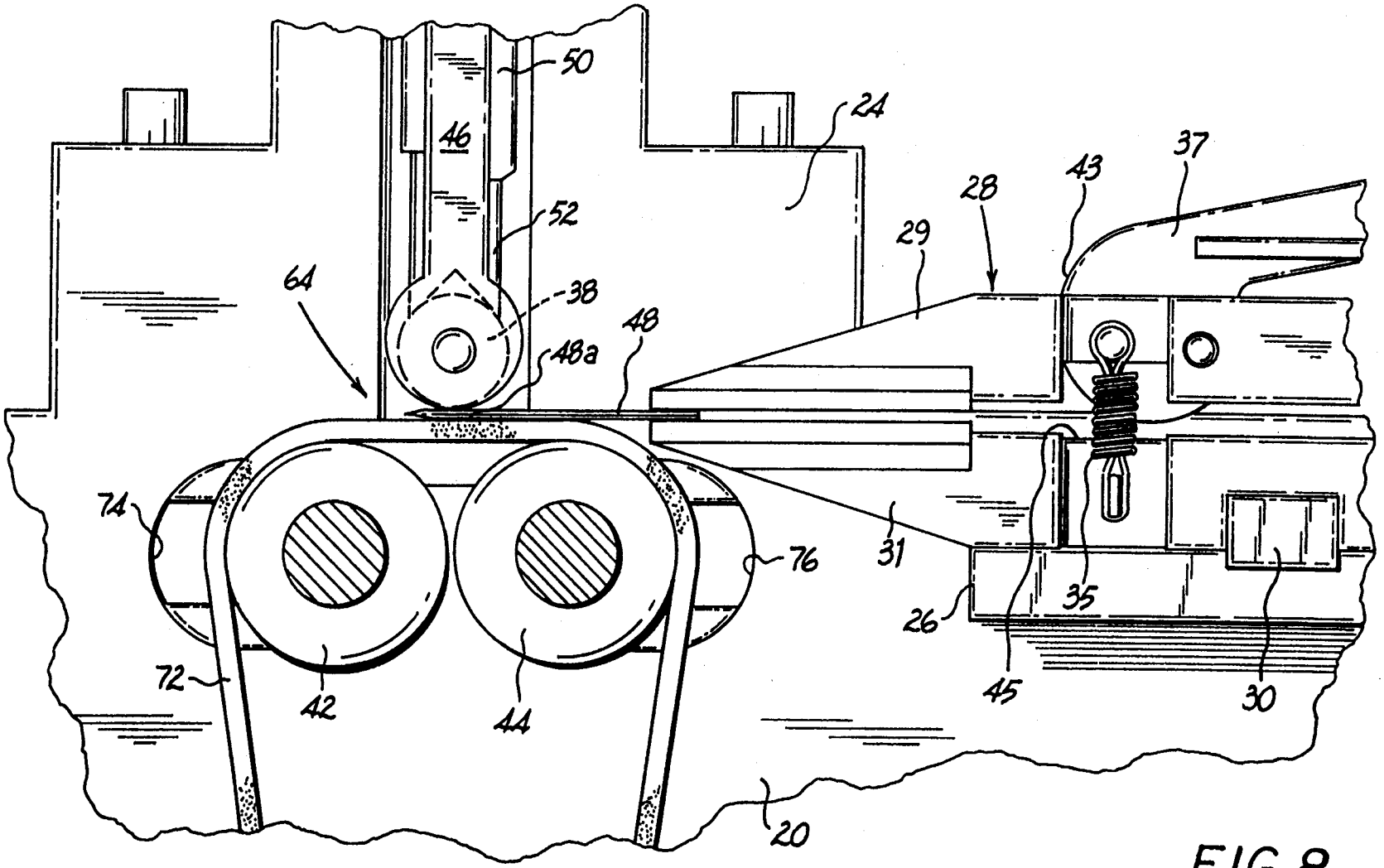
FIG. 8 is an enlarged side elevational view of the needle shaping zone of the present invention, illustrating needle blanks being supplied therein.

In operation, mandrel 38 is initially in the up position and needle clamp 28 is positioned on needle supply table 26 so that point portion 48*a* of each needle blank 48 within clamp 28 is positioned between mandrel 38 and drive belt 72 in a friction fit, as shown in FIG. 8. As mentioned above, a portion of the needle blank is typically flat pressed prior to curving, thus it is preferred that the flattened portions of the needle blank are held within the jaws of clamp 28 so that the curvature is formed along the flattened portion of the needle blank.

Figure 9:
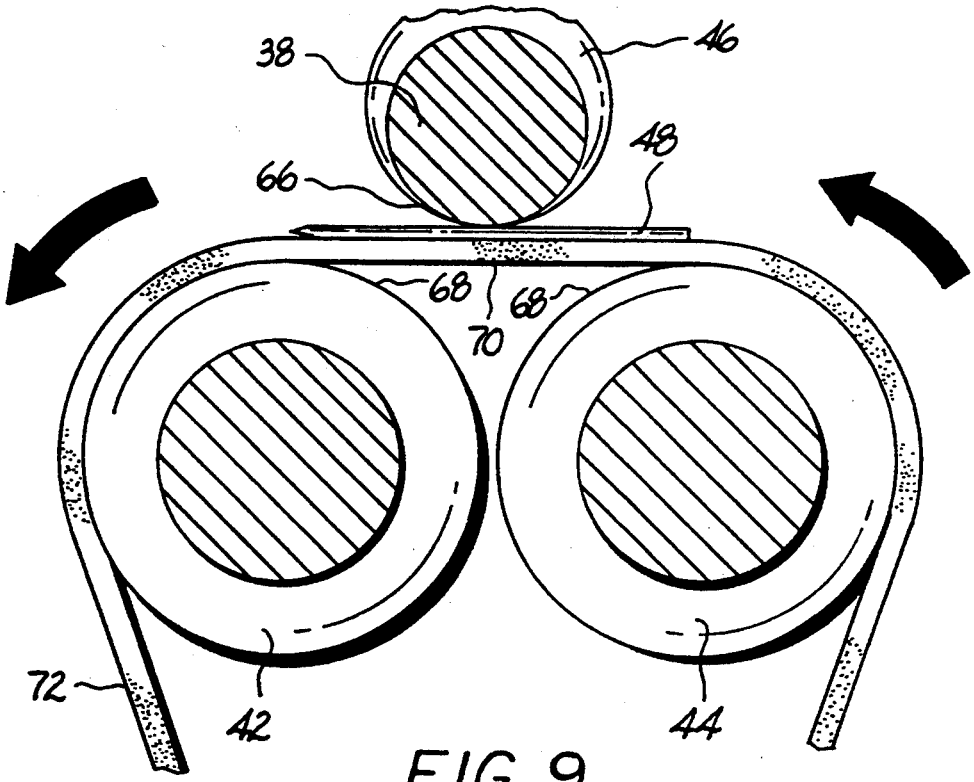
FIG. 9 is an enlarged side elevational view of the needle shaping zone similar to FIG. 8, illustrating needle blanks in the zero position.

Reciprocating system 14 is then activated so that drive belt 72 and rollers 42 and 44 rotate a predetermined distance. As a result, needle blanks 48 are pulled free from clamp 28 and move along drive belt 72 into the needle curving zone until the needle blank reaches the zero position. The zero position is the position where the approximate center of each needle blank 48 is aligned under mandrel 38, as shown in FIG. 9.

Figure 10:
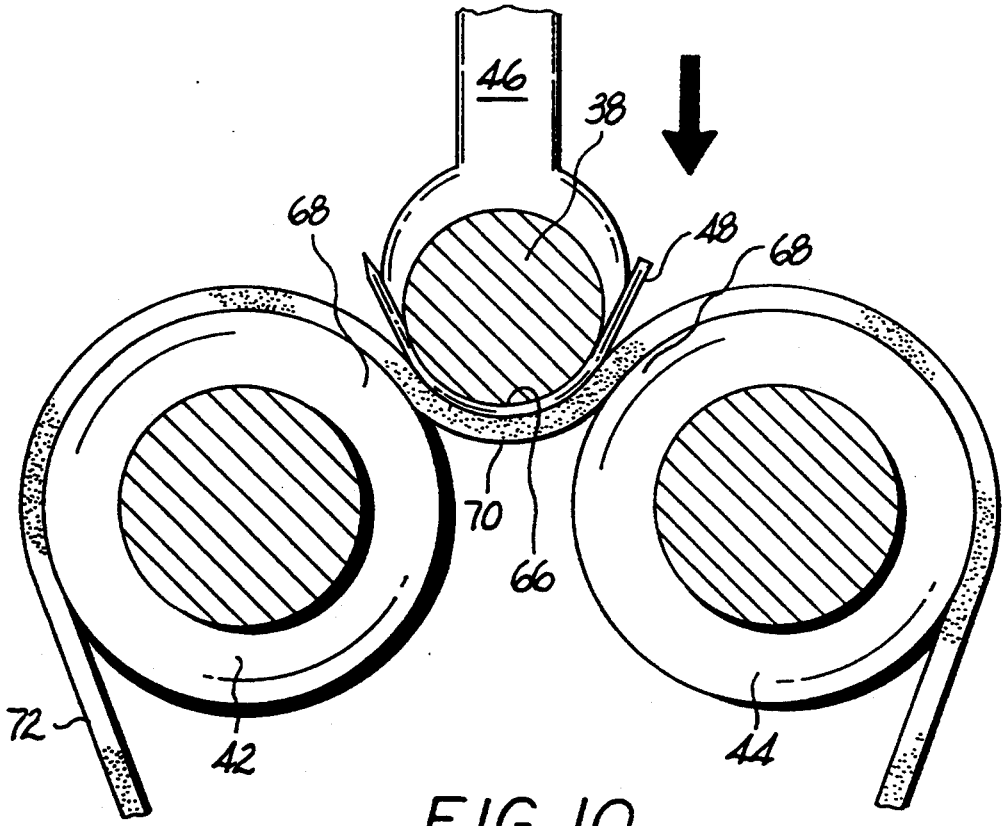
FIG. 10 is an enlarged side elevational view similar to FIG. 9, illustrating an activated curving system and reciprocating system forming the initial bend in the needle blanks.

Once in the zero position, mandrel drive system 40 is actuated to lower mandrel 38 into contact with needle blank 48 so as to spread rollers 42 and 44 apart and form a substantially "U" shape in each needle blank 48, i.e., into a curved center position with two substantially straight arms, as shown in FIG. 10.

Figure 11:
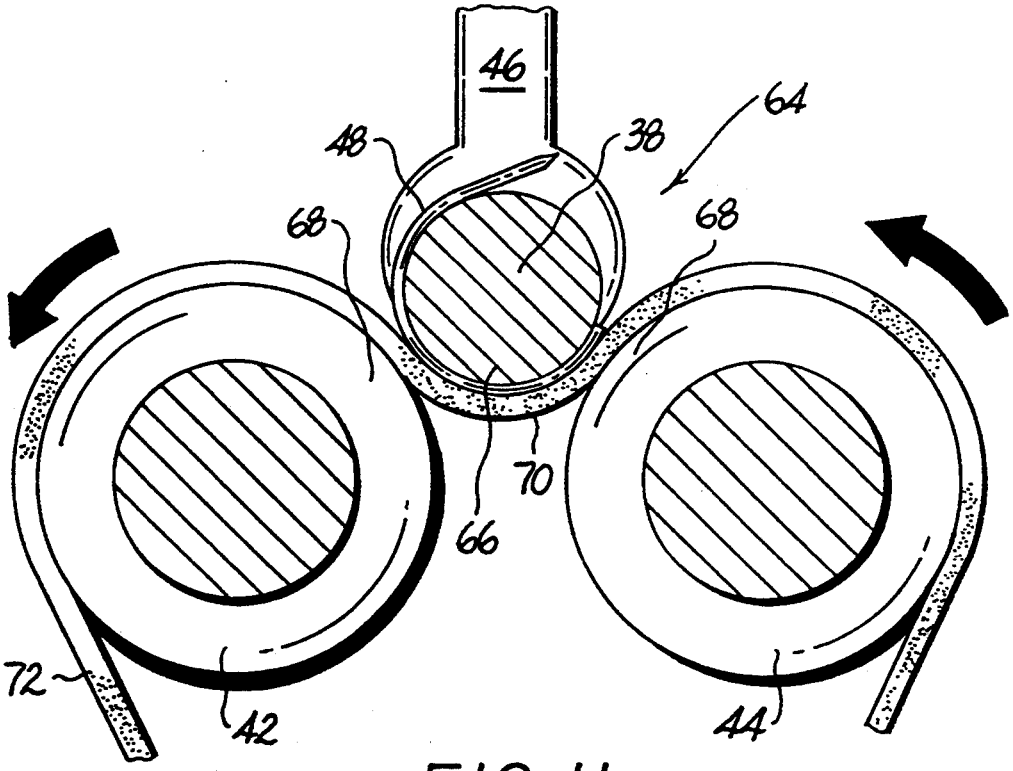
FIG. 11 is an enlarged side elevational view similar to FIG. 10, illustrating the needle blanks being rotated in the needle shaping zone to bend the barrel of each needle blank.

After forming the "U" shape in each needle blank, drive system 45 of reciprocating system 14 is activated to advance drive belt 72 so that rollers 42 and 44 are rotated counter-clockwise from the zero position a distance sufficient to uniformly and continuously bend one straight arm of the U-shaped needle blank to the desired radius of curvature, as shown in FIG. 11.

Figure 12:
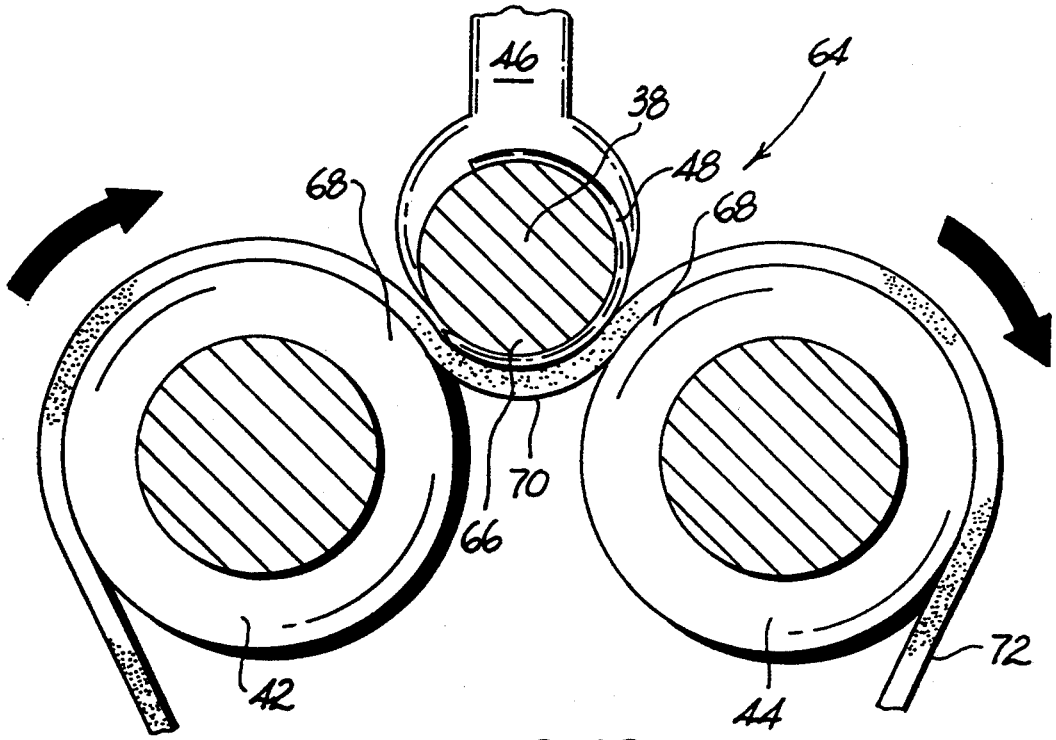
FIG. 12 is an enlarged side elevational view similar to FIG. 11, illustrating the needle blanks being rotated in the opposite direction to complete the bending of the needle blanks.

To bend the remaining straight portion of each needle blank, the direction in which drive belt 72 is driven is reversed and rollers 42 and 44 are rotated clockwise back toward and through the zero position a distance sufficient to uniformly and continuously bend the remaining straight portion of each needle, as shown in FIG. 12. The needle is then rotated counter-clockwise to the zero position for subsequent release of the newly curved needle.

Once the needle is returned to the zero position, mandrel 38 is raised and drive belt 72 is again rotated so as to deposit the newly curved needle into needle recovery assembly 32, as mentioned above.

It will be understood that various modifications can be made to the embodiments of the present invention herein disclosed without departing from the spirit and scope thereof. For example, various sizes of the instrument are contemplated, as well as various types of construction materials. Also, various modifications may be made in the configuration of the parts. Therefore, the above description should not be construed as limiting the invention but merely as exemplifications of preferred embodiments thereof. Those skilled in the art will envision other modifications within the scope and spirit of the present invention as defined by the claims appended hereto.

What is claimed is:

1. An apparatus for curving surgical needle blanks, which comprises:

a mandrel selectively movable between first and second positions;

at least one pair of biasing members movable relative to each other and positioned adjacent said mandrel when said mandrel is in said second position;

plurality of compression arms coupled to said at least one pair of biasing members such that said compression arms move said biasing members to a closed position relative to each other, and apply a continuous biasing force to said at least one pair of biasing members when said biasing members are moved to a separated position by said mandrel when said mandrel moves to said second position; and an elastomeric member positioned between said mandrel and said at least one pair of biasing members, such that when said mandrel is in said second position, surgical needle blanks positioned between said mandrel and said elastomeric member are biased toward said mandrel by said at least one pair of biasing members and said elastomeric member.

2. The apparatus according to claim 1, wherein said mandrel has a radius of curvature in the range of between about 0.05 inches and about 3.00 inches.

3. The apparatus according to claim 1 further comprising a drive assembly in engagement with said elastomeric member, said drive assembly being configured to move said elastomeric member in a first direction wherein a first portion of the surgical needle blanks is curved and in a second direction wherein a second portion of the surgical needle blanks is curved.

4. The apparatus according to claim 1 further comprising at least one tensioning member engaged with said elastomeric member.

5. The apparatus according to claim 1, wherein said elastomeric member is formed of a material selected from the group consisting of Neoprene, Nylon, Polyurethane or Kevlar.

6. An apparatus for forming curved surgical needles, which comprises:

curving means for imparting an arcuate profile to at least a portion of surgical needle blanks; and means including at least two biasing members movable relative to each other, a plurality of compression arms coupled to said at least two biasing members such that said compression arms move said biasing members to a closed position relative to each other, and apply a continuous biasing force to said at least two biasing members when said curving means is moved adjacent said biasing members to cause said biasing members to move to a separated position, and an elastomeric member positioned between said curving means and said at least two biasing members adjacent said curving means, for biasing surgical needle blanks positioned between said curving means and said elastomeric member toward said curving means, and for moving the surgical needle blanks in a first direction wherein at least a first portion of the needle blanks are curved and in a second opposite direction wherein a second portion of the needle blanks are curved.

7. The apparatus according to claim 6, wherein said curving means comprises a mandrel selectively movable between a first position and a second position, said second position being adjacent said biasing means.

8. The apparatus according to claim 6 further comprising at least one tensioning member engaged with said elastomeric member so as to maintain said elastomeric member in a taught relationship with said at least two biasing members.

9. The apparatus according to claim 6, wherein said elastomeric member is formed of a material selected from the group consisting of Neoprene, Nylon, Polyurethane or Kevlar.

10. An apparatus for forming curved surgical needles, which comprises:

a mandrel secured between side walls of a frame and slidable with respect thereto, such that said mandrel is movable between first and second positions;

at least one pair of biasing members positioned adjacent said mandrel and movable relative to each other;

an elastomeric member positioned between said mandrel and said at least one pair of biasing members such that when said mandrel is in said second position, said mandrel, said at least one pair of biasing members and said elastomeric member define a needle curving zone;

means for supplying needle blanks to said needle curving zone; and means for recovering needle blanks after curving when said mandrel is in said first position.

* * * * *